United States Patent [19]

Lewellen, III

[11] Patent Number: 4,781,812

[45] Date of Patent: Nov. 1, 1988

[54] DANGLER CABLE AND METHOD OF SECURING AN ELECTICAL CABLE TO A CATHODE MEMBER

[75] Inventor: Wendell G. Lewellen, III, Ann Arbor, Mich.

[73] Assignee: Imperial Industries Inc., Belleville, Mich.

[21] Appl. No.: 107,004

[22] Filed: Oct. 8, 1987

[51] Int. Cl.[4] ..... C25D 17/00; H01R 5/08

[52] U.S. Cl. ..... 204/279; 439/882

[58] Field of Search ..... 204/279, 213–214; 439/882, 883, 877, 878

[56] References Cited

U.S. PATENT DOCUMENTS

| | | | |
|---|---|---|---|
| 2,002,220 | 5/1935 | Douglas | 439/877 X |
| 2,034,090 | 3/1936 | Douglas | 439/886 |
| 2,060,864 | 11/1936 | Hedler | 439/877 X |
| 2,147,239 | 2/1939 | Buchanan | 439/863 |
| 2,165,323 | 7/1939 | White | 439/886 |
| 2,249,609 | 7/1941 | Jackson | 204/213 |
| 2,297,785 | 10/1942 | Lake | 439/866 |
| 3,366,566 | 1/1968 | Sandrock | 204/279 X |
| 3,573,721 | 4/1971 | Teagno et al. | 439/883 X |
| 3,798,589 | 3/1974 | Deardurff | 439/866 |
| 3,844,923 | 10/1974 | Sandrock | 204/279 |
| 3,860,320 | 1/1975 | Danner | 439/275 |
| 3,922,058 | 11/1975 | Kinnear | 439/811 |
| 4,111,781 | 9/1978 | Smith et al. | 204/213 X |
| 4,288,311 | 9/1981 | Singleton et al. | 204/279 |

*Primary Examiner*—Donald R. Valentine

*Attorney, Agent, or Firm*—Cullen, Sloman, Cantor, Graver, Scott & Rutherford

[57] ABSTRACT

A dangler cable for use in both horizontal and oblique electroplating processes is disclosed. The dangler cable includes an electrical cable having an insulating sheath surrounding a plurality of groups of wire strands. One end of the electrical cable is stripped of the insulating sheath, whereby a portion of the wire strands extend from the insulating sheath. A cathode member having a metal sleeve is secured to the stripped end of the electrical cable by crimping one end of the sleeve coaxially of the electrical cable and flattening the other end of the sleeve. In addition, the other end of the electrical cable is provided with a connector member to secure the dangler cable to a bus bar of an electroplating apparatus. There is also disclosed the method of using the novel dangler cable in an electroplating process and the method of securing a cathode member to an electrical cable.

9 Claims, 2 Drawing Sheets

DANGLER CABLE AND METHOD OF SECURING AN ELECTICAL CABLE TO A CATHODE MEMBER

FIELD OF THE INVENTION

The present invention relates to a electroplating in general, and a dangler cable in specific. One aspect of the dangler cable is that is can be easily manufactured and utilized in a variety of plating processes.

BACKGROUND OF THE INVENTION

Electroplating processes employing horizontally rotating barrels are known within the art as disclosed, for example, in U.S. Pat. Nos. 3,860,320 (Danner) and 2,249,609 (Jackson). In such a system, a cable extends into the barrel through one or both ends at the axis of rotation of the barrel. Each cable typically has a cathode member secured to the free-end within the barrel for conducting plating current through an electrolyte to the workpieces tumbling in the barrel. It is common practice to secure the cathode member to the end of the cable by soldering, crimping,swaging or the like as disclosed, for example, in U.S. Pat. No. 3,844,923 (Sandrock). This provides for intimate contact between the conductor and the cathode member.

A problem in the field has been the buildup of plate material on the steel knob forming the cathode member of the dangler cable. This buildup has reached the degree where damage to the finished workpieces has been a problem. Such buildup of plate can become severe so as to damage the work during the tumbling process. One example where this problem occurred resulting in damage to the work was in the cooper cyanide plating of zinc blanks which are sold to the U.S. Mint and struck in the manufacturing of U.S. one cent pieces.

A second problem is that of the wasted material represented by the excess copper "buildup" on the dangler knob or cathode member. It has been desired when the danglers become unusable that the knob or cathode member be severed from the cable and the excess material by reused as anode material in the plating process. However, this object has not been achieved due to the large portion of steel represented by the knob which acts as a substrate to this buildup of copper. The iron in the steel causes a contamination of the plating solution. In addition, should the knob be soldered to the cable, the tin and lead represent additional contaminants. As a result, the "used" knobs have been sold at a discount to copper scrap dealers.

Several manufacturers have in the past manufactured prototype danglers having replaceable copper knobs. The purpose of this design was to permit the knob or cathode member after severe buildup of copper had occurred to be removed and then used as anode material resulting in the complete deterioration of the copper buildup and the copper knob itself in the electroplating process.

The problems encountered with the replaceable copper knob design were twofold: First, the actual replacement of the copper knob was somewhat unwieldy resulting in excess machine downtime. Second, the cost of a dangler with replaceable copper knob(s) has been prohibitive. The dangler cable itself can withstand the abrasion which occurs during two "dangler knob lives". As a result, this additional cost does not offset the disadvantage of not using the "knob" as anode material.

SUMMARY OF THE INVENTION

In contrast to the electroplating processes and cables acknowledged above, the dangler cable of the present invention provides advantages and features over commercial designs.

The simple swaged copper knob of the present invention is smaller in size and mass than the conventional steel knob. As a result, more extensive buildup can accumulate before it becomes necessary to remove the knob from the cable.

Another feature is the removal of the knob is accomplished by simply severing the knob from the cable. The "spent" knob is then used as anode material and since it is essentially all copper, the only material remaining after the complete deterioration of the copper material is a small piece of Hypalon brand dangler cable jacket. This material is inert in the plating solution and is easily accumulated and disposed of.

Still another feature is the cost of manufacturing this dangler is low, actually costing less than the conventional dangler having a steel knob.

A further feature is the dangler cables themselves are easily salvaged for use a second time. The cable is stripped and a second copper knob is swaged in place in order to accomplish this.

For customers performing an electroplating process other than copper, the dangler product is marketable due to its competitive cost of manufacture.

The dangler cable of the present invention for use in electroplating processes includes an electrical cable. The electrical cable has an insulating sheath surrounding a plurality of spirally wound groups of wire strands extending axially therein. One end of the electrical cable is stripped, whereby the wire strands protrude axially past the insulating sheath. The cathode member includes a metal sleeve opened at both ends. One end of the sleeve is expanded, forms the major inside diameter, and has a length of approximately $\frac{5}{8}''$. The expanded end of the sleeve is slipped over the insulating sheath of the cable. The other end of the cable has the smaller or minor inside diameter and it extends over the exposed wire strands and once in place is flattened to secure the sleeve to the conductor and provide intimate electrical contact therebetween. A coaxial crimp is then installed and serves the sole purpose of sealing the joint between the sleeve and the insulating sheath. The disclosed embodiment includes a connector member secured to the other end of the electrical cable which secures the cable to an electrical power source.

The method of the present invention for securing the cathode member to at least one end of an electrical cable includes the step of stripping an insulating sheath from one end of a electrical cable, whereby a plurality of groups of wire strands extend therefrom. An elongated tubular metal sleeve is provided which has a length greater than the length of the stripped wire strands. The sleeve has an enlarged socket at its leading end portion and a smaller opening at the trailing end portion. The next step is sliding the tubular metal sleeve over the extending wire strands and over the adjacent insulating sheath. Another step is flattening the trailing end portion of the metal sleeve to form at least one pair of elongated flats therealong. Next, a crimping step is provided on the leading end of the metal sleeve coaxially of the electrical cable to secure the metal sleeve over the insulating sheath.

The method of the present invention for using the novel cathodic dangler cable with an electroplating apparatus includes the step of introducing the cathodic dangler cable into the plating barrel. The anode basket contains the material to be deposited during the plating process and is external to the barrel. Cation transfer and concurrent flow of electricity takes place through the conductive electroplating solution. The dangler cable is connected to a power source, and the barrel is at least partially submerged in an electrolyte tank. Next, the barrel is rotated about an axis so that workpieces contained within the barrel tumble while being subjected to an electrical current. In the preferred method, the cathode member includes a tubular metal sleeve secured on its leading end portion to the electrical cable by being crimped at one end coaxially with the electrical cable. Also, the metal sleeve includes at least two elongated flats along the trailing end portion of the metal sleeve. In copper electroplating, the tubular metal sleeve is made from copper. After a period of time, copper builds up on the cathode copper sleeve which could damage the workpieces. As a result, the method includes the steps of severing the copper cathode sleeve from the cable and placing the severed copper sleeve in the anode basket of the electroplating apparatus for use as a source of copper to be subsequently deposited on workpieces. A new copper sleeve or cathode member is swaged in place to the stripped end of the cable.

BRIEF DESCRIPTION OF THE DRAWINGS

The various features, objects, benefits, and advantages of the present invention will become more apparent by reading the following detailed description of the preferred embodiment in conjunction with the drawings wherein like reference numerals identify corresponding components, and.

DETAILED DESCRIPTION OF THE PREFERRED EMBODIMENT

Figure 1:
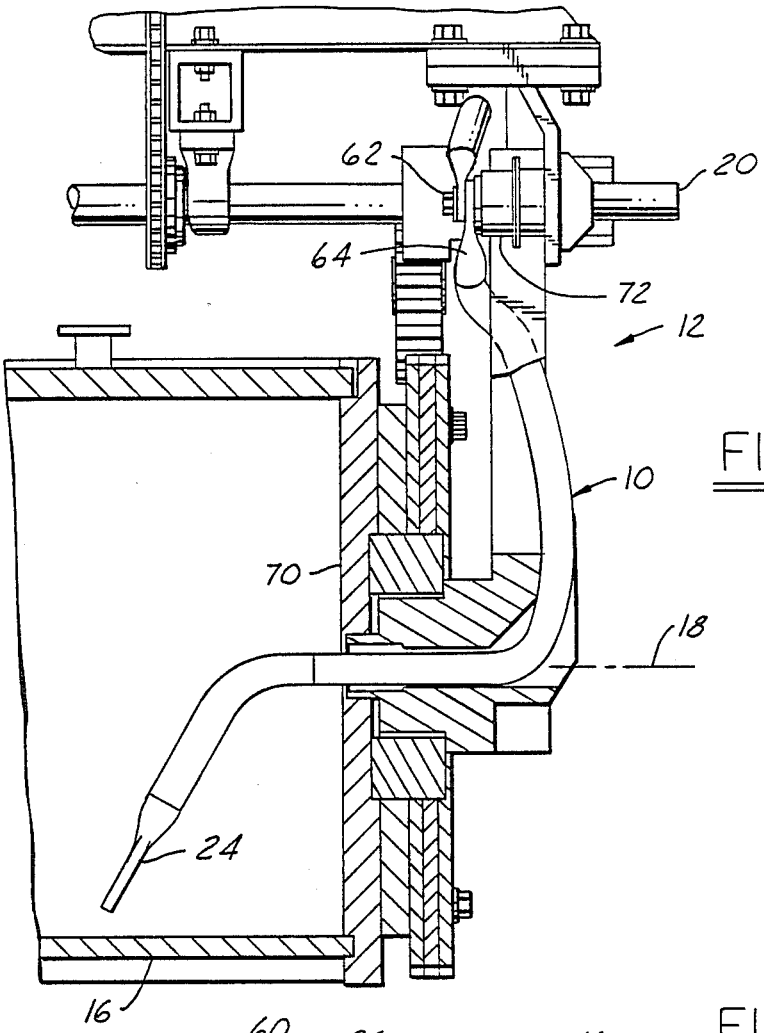
FIG. 1 is a fragmentary view, with parts broken away, illustrating one end of a horizontal apparatus utilizing a dangler cable of the present invention.
Figure 2:
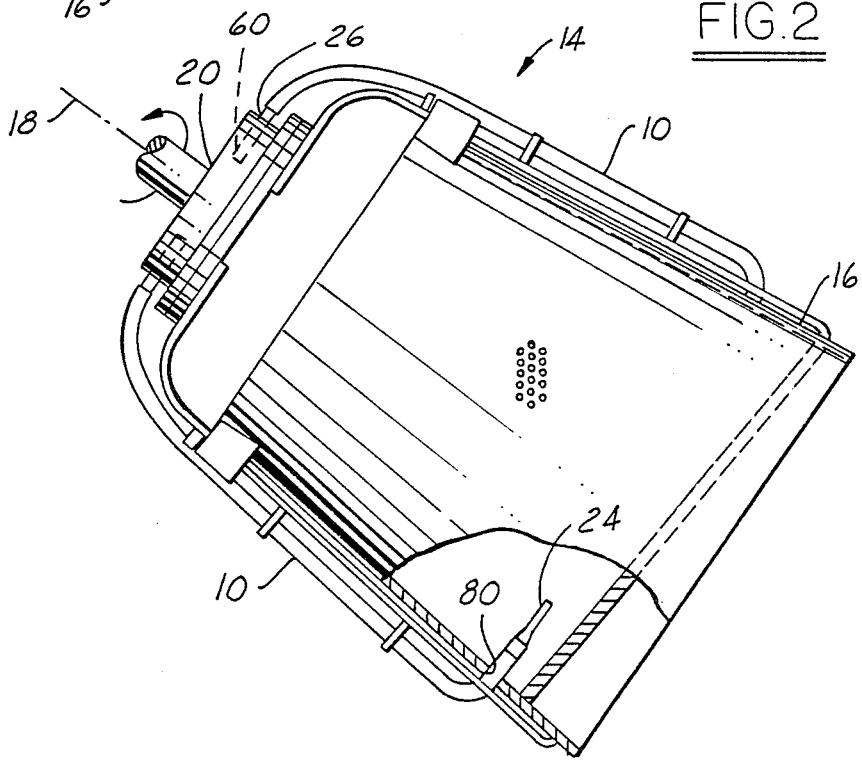
FIG. 2 is a fragmentary view, with parts broken away, illustrating an oblique plating apparatus utilizing a dangler cable of the present invention.

Referring to FIGS. 1 and 2, the dangler cable of the present invention, generally designated 10, is illustrated as utilized with a horizontal electroplating apparatus 12 or an oblique electroplating apparatus 14. The particular electroplating apparatus is not essential to the present invention and may also include, for example, those disclosed in U.S. Pat. Nos. 3,860,320 (Danner) and 2,249,609 (Jackson), the disclosures of which are hereby incorporated by reference. Typically, such apparatus include an electrolyte tank with an anode basket (not shown) in which a perforated barrel 16 is supported. A means (not shown) is typically provided for rotating the barrel about an axis 18 for either horizontal rotation as illustrated in FIG. 1 or for oblique rotation as illustrated in FIG. 2. In both situations, the barrel 16 is open or perforated to facilitate flow of electrolyte about workpieces contained within the barrel 16 for plating. As illustrated in FIGS. 1 and 2, the dangler cable 10 is connected at one end to a bus bar 20.

Figure 3:
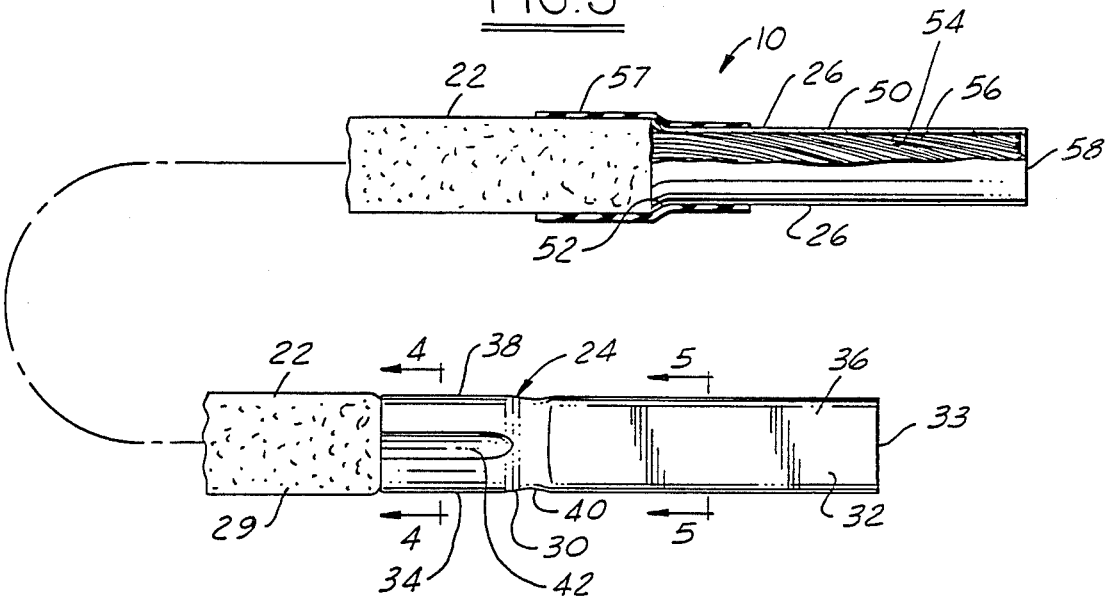
FIG. 3 is a fragmentary, side view of the dangler cable of the present invention, partially in section.
Figure 4:
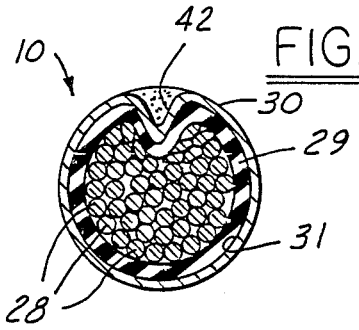
FIG. 4 is an enlarged cross-sectional view of the dangler cable illustrated in FIG. 3 taken in the direction of arrows 4—4 through the crimped section of the cathode member showing the wire strands and protective insulating sheath.
Figure 5:
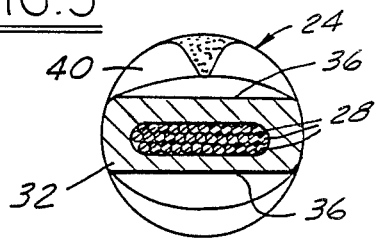
FIG. 5 is an enlarged cross-sectional view of the dangler cable taken in the direction of arrows 5—5 of FIG. 3 showing the pair of flats of the cathode member.

Prior to assembly, the cathode member 24 is open at both ends and take the form of an elongated tubular copper tube or sleeve 30 which has been expanded on the leading end. This portion of the sleeve 30 having the major inside diameter is approximately ⅝" long and is intended to slip over the insulating sheath 29 as shown in FIGS. 3 and 4. The portion of the sleeve 30 which has the minor inside diameter slips over the exposed stripped copper wire strands and once in place is flattened as shown in FIGS. 3 and 5 so as to secure the sleeve 30 to the conductor or cable 22 and provide intimate electrical contact with it. A coaxial crimp is then installed and serves the sole purpose of sealing the joint between the sleeve 30 and the insulating sheath of the cable 22 thereby swaging the cathode member 24 to the cable 22.

As illustrated in FIG. 3 and in greater detail in FIG. 4, the dangler cable 10 includes the electrical cable 22 to which the cathode member 24 is secured at one end forming the "knob end" of the cable and a conventional connector member 26 at the other end forming the "lug end" of the cable. The "lug end" may take the form of that shown in FIG. 3 or more commonly, a modified form of connector quite similar to the "knob end" but having a hole through the flattened portion of the lug 64 and allowing for a bolted connection as in FIG. 1 as will be discussed later in the specification. The cable 22 has a plurality of spirally wound groups of wire strands 28 surrounded by an insulating sheath 29, as illustrated in FIG. 4. The cathode member or knob end 24 is secured to a stripped end of the electrical cable 22, as illustrated in FIGS. 3 and 4. This connection utilizes the metal sleeve 30 having a central bore 31, and a trailing end portion 32 and a leading end portion 34. The trailing end portion as a pair of flats 36 running along the length of the metal sleeve 30 towards the leading end portion 34 as illustrated in FIGS. 3 and 5. The leading end portion 34 includes a cylindrical socket portion 38 extending along the length of the sleeve 30 from the leading end towards the trailing end. A shoulder portion 40 joins the flats 36 with the socket portion 38. The central bore 31 correspondingly tapers along the shoulder 40 and terminates at the flats 36 to provide for a snug fit of the wire strands 28 which usually extend through the end face 33.

To secure the sleeve 30 forming the cathode member 24 to the electrical cable 22 as illustrated in FIGS. 3, 4 and 5, the end of the electrical cable 22 is first stripped of the insulating sheath 29. Then, the stripped end of the cable is manually inserted into the leading end portion 34 of the metal sleeve 30 as far as possible. As an example, if the insulation is stripped about 1½ inches, the sleeve 30 is slid over the adjacent insulating sheath about ⅝". Next, the trailing end portion of sleeve 30 is shaped by a forming die (not shown) to form the elongated pair of opposed and parallel flats 36. Lastly, the cylindrical socket portion 38 of sleeve 30 is placed in a die (also not shown) and crimped coaxially with the electrical cable at 42 to secure the cathode member 24 on the cable as illustrated in FIGS. 3, 4 and 5.

As also illustrated in FIG. 3, the connector member 26 includes a metal sleeve 50 having an open flared end 52 and a central bore 54. The bore is dimensioned to accommodate a second stripped end 56 of the electrical cable 22. The end of the cable is stripped of the insulating sheath 29 and inserted through the open flared end as far as it will go, whereby the flared end 52 is adjacent the insulating sheath 29. Then, a cylindrical socket 57, of for example heat shrinkable material, is placed over the electrical cable and the connector member 26 adjacent the flared end to secure them together. The other end 58 of the connector member 26 is open, and is sealed as a result of a soldered connection. In this manner, the connector member 26 may be inserted into a bore 60 formed in the bus bar 20. As an alternative, the connector end of the cable may be provided with a conventional lug 64 which is connected to the bus bar 20 by a nut and bolt combination 62, as illustrated in FIG. 1 and disclosed in U.S. Pat. No. 2,249,609 (Jackson). This requires the use of a connection member or lug 64 on the lug end of the cable. The lug has flat sides and a bolt opening along the flats to accommodate the nut and bolt combination 62.

The particular material of which the cathode member 24 is made is not particularly essential to the present invention and may include any number of metallic materials. Copper metal has been found to be preferred when electroplating copper on, as an example, a zinc part so that when the cathode member 24 becomes too heavy because of deposit buildup it can be cut off from the end of the cable and placed in the anode basket. This enables the use of virtually all of the copper in the electroplating process. However, the manufacturer of this product may choose the best material based upon economics, availability and the electroplating process.

Operation and Use

The operation and use of the dangler cable 10 of the present invention with horizontal and oblique electroplating apparatus 12 and 14 will not be explained. As illustrated in FIG. 1, the flattened knob end forming the cathode member 24 of the dangler cable 10 may be introduced into the barrel 16 through an end wall 70. In the illustrated embodiment, the lug end of the cable is operatively connected to the bus bar 20. Similarly, as illustrated in FIG. 2, the flattened knob end forming the cathode member 24 of the dangler cable 10 extends through an aperture 80 formed in the wall of the barrel 16 to come in contact with the workpieces being plated. In these manners, the workpieces are tumbled within the barrels 16 to be uniformly plated with, for example, copper as a result of electrical current flowing therethrough.

The copper knob or cathode member 24 is smaller in size and mass than the conventional steel knob. As a result, more extensive metal buildup can accumulate on the cathode member before it becomes necessary to remove the knob or cathode member from the cable.

Removal of the cathode member 24 is accomplished by simply severing the copper knob from the cable. The "spent" knob is then used as anode material and since it is essentially all copper, the only material remaining after the complete deterioration of the copper material is a small piece of Hypalon brand dangler cable jacket. This material is inert in the plating solution and is easily accumulated and discarded. The cost of manufacturing the dangler cable is low, actually costing less than the conventional dangler having a steel knob.

The dangler cables themselves made according to the present invention are easily salvaged for use a second time. The cable is stripped and a second copper knob or sleeve 30 is swaged in place.

While the preferred embodiment of the present invention has been described so as to enable one skilled in the art to practice the techniques of the present invention, the preceding description is intended to be exemplary and should not be used to limit the scope of the invention. The scope of the invention should be determined only by reference to the following claims.

I claim:

1. A dangler cable for use in an electroplating process, comprising:

an electrical cable having an insulating sheath and a plurality of spirally wound groups of wire strands extending axially therein, said electrical cable having a pair of ends including one end which is stripped, whereby said wound groups of wire strands protrude axially pass said insulating sheath;

a connector member secured to the other end of said electrical cable; and a cathode member including an elongated tubular metal sleeve having leading and trailing end portions; said leading end portion having an inside diameter larger than the outside diameter of the electrical cable;

said tubular metal sleeve extending over and completely surrounding the stripped wire strands of said electrical cable, with said leading end portion extending over the insulating sheath;

said cathode member being secured to said insulating sheath adjacent said strip end by at least one crimp formed along the leading end portion of said metal sleeve extending coaxially of said electrical cable;

said trailing end portion of said metal sleeve being provided with a pair of opposed and generally parallel flats throughout its length which reduces the thicknes of said groups of wire strands therein.

2. The dangler cable defined in claim 1, wherein said trailing end portion of said metal sleeve has a terminal end surface and is provided with said pair of opposed and generally parallel flats throughout its length which reduces the thickness of said groups of wire strands therein, the ends of said wire strands being exposed at the terminal end surface of said trailing end portion.

3. The dangler cable defined in claim 1, wherein said leading end portion of said metal sleeve includes a cylindrical socket portion of generally circular cross-section receiving part of said insulating sheath and which is provided with said crimp.

4. The dangler cable defined in claim 1, wherein said metal sleeve is made from copper.

5. A dangler cable for use in an electroplating process, comprising:

an electrical cable having an insulating sheath and a plurality of spirally wound groups of wire strands extending axially therein, said electrical cable having a pair of ends including one end which is stripped, whereby said wound groups of wire strands protrude axially pass said insulating sheath;

a connector member secured to the other end of said electrical cable; and a cathode member including an elongated tubular metal sleeve having leading and trailing end portions; said leading end portion having an inside diameter larger than the outside diameter of the electrical cable;

said tubular metal sleeve extending over and completely surrounding the stripped wire strands of said electrical cable, with said leading end portion extending over the insulating sheath;

said cathode member being secured to said insulating sheath adjacent said strip end by at least one crimp formed along the leading end portion of said metal sleeve extending coaxially of said electrical cable;

wherein said leading end portion of said metal sleeve includes a cylindrical socket portion of generally circular cross-section receiving part of said insulating sheath and which is provided with said crimp;

said tubular metal sleeve including a relatively short shoulder portion between the flats of said trailing end portion and the cylindrical socket of said leading end portion.

6. A method for securing a cathode member to one end of an electrical cable, comprising the steps of:

stripping an insulating sheath from one end of an electrical cable, whereby a plurality of groups of wire strands extend therefrom;

taking a cathode member including a tubular metal sleeve having leading and trailing end portions and inserting first the leading end and then the trailing end of the sleeve over the extending groups of wire strands until the leading end overlies the adjacent insulating sheath;

flattening the trailing end portion of said metal sleeve to form at least a pair of elongated flats therealong; and crimping at least a portion of said leading end portion of said metal sleeve coaxially of said electrical cable.

7. The method defined in claim 6, wherein a shoulder portion is provided on said metal sleeve adjacent said flats and said leading end portion of said metal sleeve.

8. The method defined in claim 6, wherein said metal sleeve includes a central bore dimensioned at the leading end portion to accommodate at least a portion of the insulating sheath.

9. The method defined in claim 8, wherein said metal sleeve is made from copper.

* * * * *